US009702091B2

(12) United States Patent
Coats

(10) Patent No.: US 9,702,091 B2
(45) Date of Patent: Jul. 11, 2017

(54) RAILROAD TIE PLATE WITH INTEGRAL CLIP RETAINERS AND METHOD OF MAKING THE SAME

(71) Applicant: PANDROL LTD., Surrey (GB)

(72) Inventor: Frank Howard Coats, Thorofare, NJ (US)

(73) Assignee: PANDROL LTD., Surrey (GB)

( * ) Notice: Subject to any disclaimer, the term of this patent is extended or adjusted under 35 U.S.C. 154(b) by 130 days.

(21) Appl. No.: 14/685,778

(22) Filed: Apr. 14, 2015

(65) Prior Publication Data

US 2016/0305073 A1 Oct. 20, 2016

(51) Int. Cl.

| | |
|---|---|
| ***E01B 9/48*** | (2006.01) |
| ***E01B 9/42*** | (2006.01) |
| ***B21D 53/36*** | (2006.01) |
| ***E01B 9/40*** | (2006.01) |

(52) U.S. Cl.

CPC ..... *E01B 9/483* (2013.01); *B21D 53/36* (2013.01); *E01B 9/40* (2013.01); *E01B 9/42* (2013.01)

(58) Field of Classification Search

CPC ... E01B 9/42; E01B 9/30; E01B 9/303; E01B 9/48; B21D 53/36

USPC ..... 238/349, 351

See application file for complete search history.

(56) References Cited

U.S. PATENT DOCUMENTS

| | | | |
|---|---|---|---|
| 1,453,213 | A | 4/1923 | Tubbs |
| 4,119,271 | A | 10/1978 | Campbell |
| 4,316,578 | A | 2/1982 | Reynolds et al. |
| 4,718,604 | A | 1/1988 | Eisenberg et al. |
| 5,221,044 | A | 6/1993 | Guins |
| 6,305,613 | B1 | 10/2001 | Igwemezie |
| 6,651,896 | B1 | 11/2003 | Foan |
| 6,786,459 | B2 | 9/2004 | Pilesi |
| 6,974,087 | B2 | 12/2005 | Faichney |
| 2008/0121732 | A1 | 5/2008 | Yang |
| 2010/0224690 | A1 | 9/2010 | Igwenezie |

FOREIGN PATENT DOCUMENTS

| | | | |
|---|---|---|---|
| CA | 1236439 | | 5/1998 |
| CN | 203007744 | | 6/2013 |
| EP | 1721043 | | 4/2012 |
| GB | 2 199 062 | * | 6/1968 |

(Continued)

OTHER PUBLICATIONS

Alibaba china economic Color Painting Iron Steel railing base plate, http://www.ksalex.en.alibaba.com/product/2023163558-222618364/Al, Nov. 21, 2014.

(Continued)

*Primary Examiner* — Mark Le

(74) *Attorney, Agent, or Firm* — Gottlieb, Rackman & Reisman, PC

(57) ABSTRACT

A tie plate is formed with a profile defining two parallel protrusions with bores for receiving the respective ends of two clips. The two clips engage the flange of a rail to secure the rail to the plate, and therefore, to tie disposed below the plate. Since the protrusions are made integrally with the the plate, the resulting tie plate is able to support the rail securely even in the presence of large forces and/or twisting moments on the rail resulting from a train passing over the plate.

5 Claims, 6 Drawing Sheets

(56) References Cited

FOREIGN PATENT DOCUMENTS

| | | | |
|---|---|---|---|
| GB | 2 108 410 | * | 5/1983 |
| GB | 2 226 351 | * | 6/1990 |

OTHER PUBLICATIONS

Cornell Welding & Fabricating Ltd., Railway & Transit Components, http://www.cornell.on.ca/products/railway-transit-components, Nov. 21, 2014.
tradeKorea.com, Full set of E clip rail fastening, http://www.tradekorea.com/product/detail/P249090/Full-set-of-E-clip-r . . . , Nov. 21, 2014.
North American Rail Products Inc., Pandrol Plates for New or Relay Rail Materials, MSR Plates, Nov. 21, 2014.
Railway-Fastener.com, Rail Tie plate/Base plate, http://www.railway-fastener.com/fastenersys/pro_show-140.html, Nov. 19, 2014.
Focus Technology Co., Ltd., Railroad Tie Plate for Connecting Rail, http://mdlily.en.made-in-china.com/product/yvPJwNSjygWR/China-Rai . . . , Nov. 21, 2014.
Hanzi Industrial International Co., Ltd., Baseplate, http://www.hanzirail.com/products_detail.asp?id=918, Nov. 19, 2014.

* cited by examiner

SECTION X-X

RAILROAD TIE PLATE WITH INTEGRAL CLIP RETAINERS AND METHOD OF MAKING THE SAME

FIELD OF INVENTION

This application pertains to railroad rail fastener systems, and more particularly to a method of manufacturing a tie plate used for mounting railroad tracks on ties or other support means. The tie plate is formed with integral retainers for engaging the resilient clips used for holding the rails in place.

BACKGROUND OF THE INVENTION

Railroads constitute a major transportation means for moving goods as well as people. However, in order for railroads to operate safely, reliably and inexpensively, it is important to keep their basic infrastructure sound to ensure that the rails are available for service without any down time and are accident free.

Inherently, rails and the fastening systems used to keep the rails in place play a crucial part of the railroad infrastructure and designing such fastening systems requires a lot of interdisciplinary effort between engineers, material science experts and heavy industrial manufacturers because the fastening system must be able to hold the rails in place, with very little tolerance in the position for movement and spacing of the rails as high speed passenger trains, or long and heavy freight trains pass over them.

It has been found that fastening systems consisting of a tie plate resting on a tie or other support and somewhat resilient clips securing each rail to tie plate are advantageous because they can be made reliably with the clips being able to hold on to the rails and resist tremendous linear and rotational forces on the rails. Of course, the retainers used to hold the clips on the plate are subject to the some of the same forces as the clips and must be able to transmit these forces to the tie plate. Until the present invention, these clips were made separately and were then attached to the tie plates by welding, press-fitting or other similar mechanical means. As a result, it was possible for these retainers to separate from the tie plate, in essence making the clips useless.

SUMMARY OF THE INVENTION

In one embodiment, the present invention is directed to a method of making plates by forming a metallic piece that has a generally rectangular shape with bottom and top surface; working the metallic piece to form a shaped piece that has a generally flat body with a first end and a second end and a first protrusion and a second protrusion that extends from the first end and the second end, respectively, with the first and second ends disposed in parallel to each other, and the first and second protrusions disposed on the top surface and in parallel top each other; and drilling respective first and second bores from the first and second ends, respectively, through the body. The first and second bores extend only partially along a length of the respective protrusion and the first and second bores are spaced and configured to receive the end of a retaining clip securing a rail to said tie plate.

As a result, a tie plate for securing a rail on a tie using first and second clips that have respective clip end, is obtained including a relatively flat body that has a first end, a second end, a top surface and a first and a second protrusion that are formed integrally with the body and extend in parallel on the top surface. The first protrusion extends from the first end and second protrusion extends from the second end. The first and second protrusions are parallel to each other with the first protrusion formed with a first bore sized and shaped to receive one of the clip ends and the second protrusion formed with a second bore sized and shaped to receive the other of the clip ends. The protrusions and the clips cooperate to restrain the rail on said top surface.

Holes are also provided in the plate for mounting the plate on a tie. Advantageously, a transversal hole is provided outwardly from each bore. This hole can be used to remove debris from the respective bore to ensure that the respective clip end is seated properly within the bore.

The protrusions may extend from one end of the plate to the other, or may extend only partially from one end toward the opposite end.

DETAILED DESCRIPTION OF THE INVENTION

Figure 1:
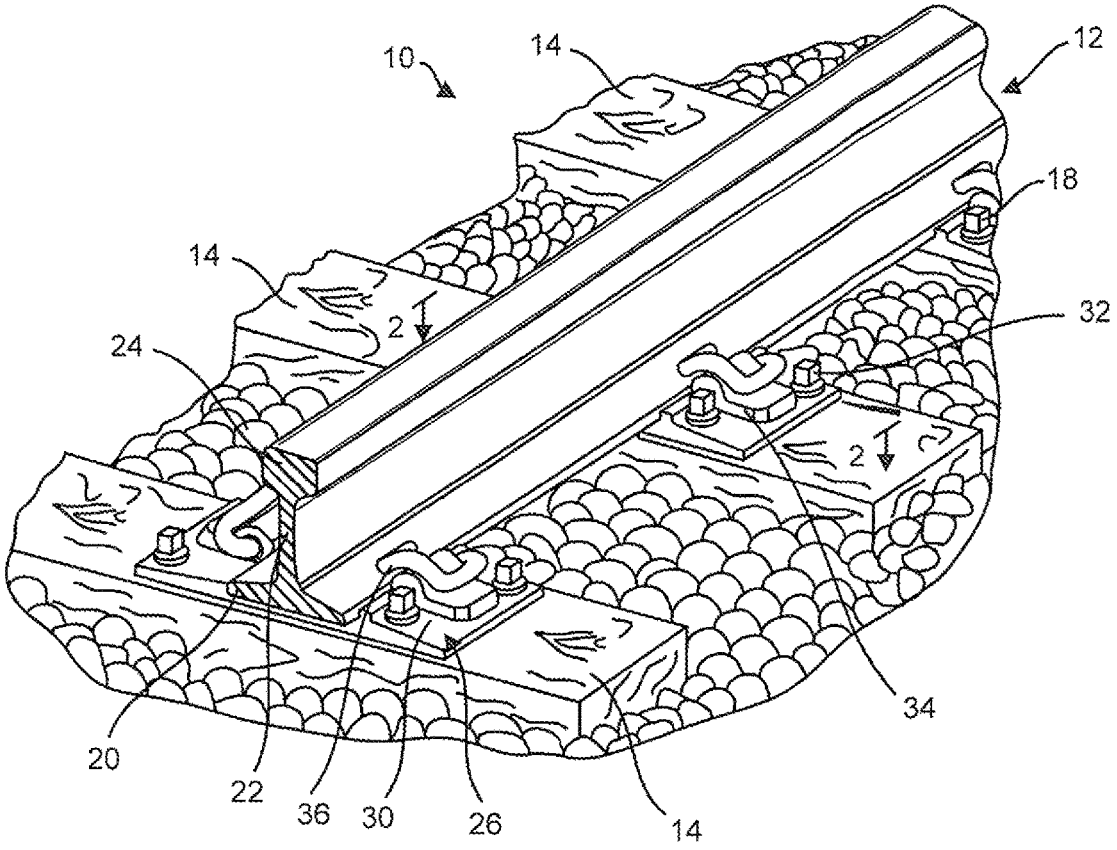
PRIOR ART FIG. 1
FIG. 1 shows an orthogonal view of a rail supported by a conventional tie plate and clip.

FIG. 1 shows a standard rail track 10 with a rail 12 resting on conventional ties 14. Rail 12 includes a foot 20, web 22 and a head 24 and is supported on the ties 14 by a support assembly 26.

Typically, the support assembly 26 includes a tie plate 30 resting directly or indirectly on a tie 14 and secured by several spikes 32 or other conventional means. In the configuration shown in FIG. 1, the assembly 26 further includes a clip retainer or bushing 34 receiving an end of a clip 36. The bushing 34 is welded or otherwise affixed to the tie plate 30. The clip 36 has another end that is contact with an upper surface of rail foot 20. The clip applies a force on the rail 12 to insure that the rail 12 stays on top of the tie and plate 30 and does not move sideways or travel too much up and down.

The support assembly 26 has several disadvantages. It requires the bushings 34 to be mounted at the factory, thereby adding to the costs of the assembly. The bushings 34 add significant weight to the assembly. In use, the bushings 34 may separate and fall off the plate 30 resulting in a potentially dangerous condition.

Figure 2A:
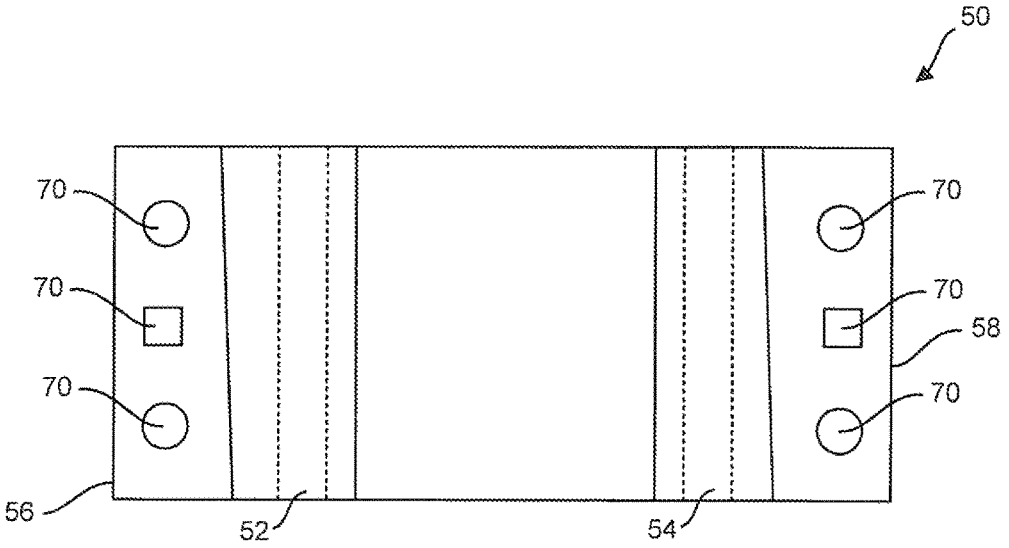
PRIOR ART FIG. 2A
FIGS. 2A and 2B show plan and side views respectively of another conventional plate.
Figure 2B:
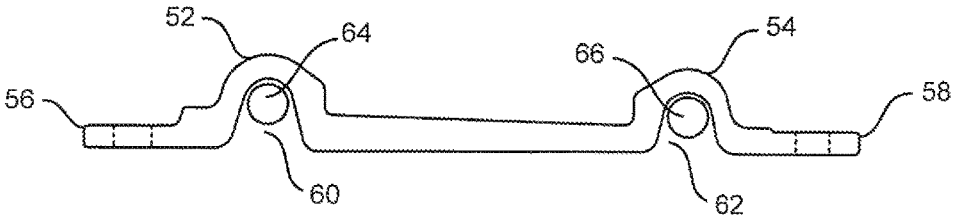
PRIOR ART FIG. 2B

FIGS. 2A and 2B show a conventional plate 50 with a different configuration. While plate 30 is generally flat, plate 50 is formed with two parallel humps 52, 54 extending in parallel with the lateral edges 56, 58. Each hump 52, 54 forms a somewhat semicylindrical cavity 60, 62. These cavities 60, 62 being sized and shaped to receive the respective ends 64, 66 of clips similar to clips 36 in FIG. 1 and used to retain the rail 12 on the tie plate 50 as described above. Holes 70 are used to secure the tie plate 50 to one of the ties 14 by spikes or other conventional means.

Plate 50 is cheaper to make then the plate 30. In addition, since the plate itself holds the ends of the clips, no additional clip retaining means such as bushings are required. Therefore, plate 50 is lighter and takes less time to assemble. However, it has been found that during the process of shaping the plate in the configuration shown, the portions of the plate forming the humps 52, 54 can become thinner than the rest of the plate. The humps are subject to tremendous forces as a heavy train goes over the plate, and after a time these humps 52, 54 can fracture. Moreover, because the cavities 60, 62 have typically a transversal shape that is larger than the cross-sectional diameters of the clips, the ends of clips 64, 66 are free to travel up and down with each wheel passing over the plate, causing excessive wear and tear of the plate and the clip ends.

FIGS. 3A-3E show a new tie plate. This plate 80 is still generally flat but is formed with two protrusions 82, 84. Each protrusion 82, 84 has a top surface 82A, 84A that is relatively cylindrical, except for two substantially vertical sections 86A, 86B facing each other and extending in parallel.

Figure 3A:
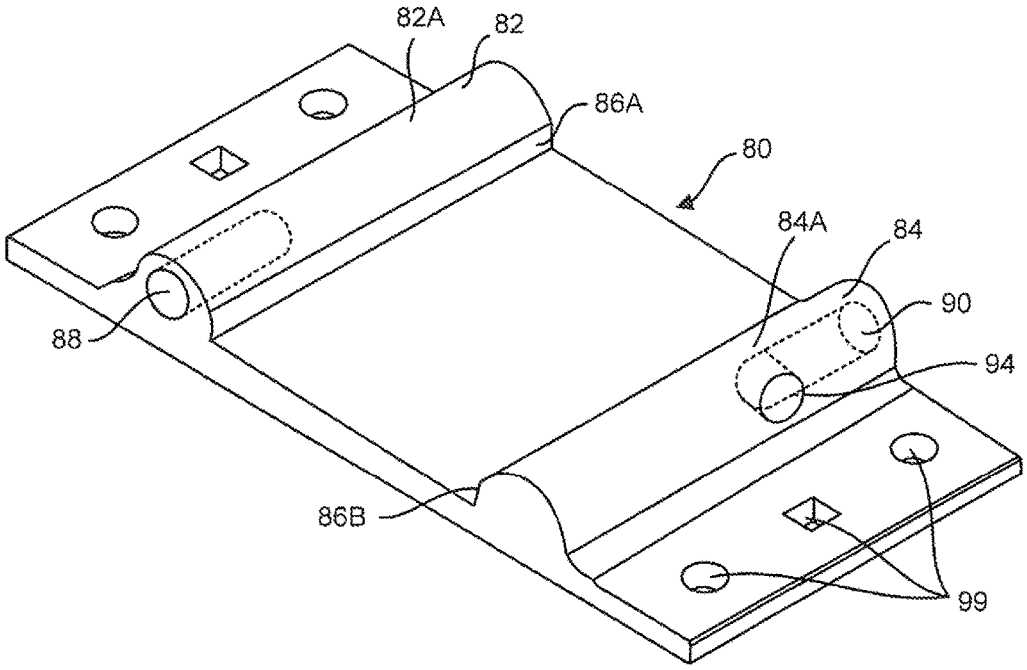
FIG. 3A shows an orthogonal view of a tie plate constructed in accordance with this invention.
Figure 3B:
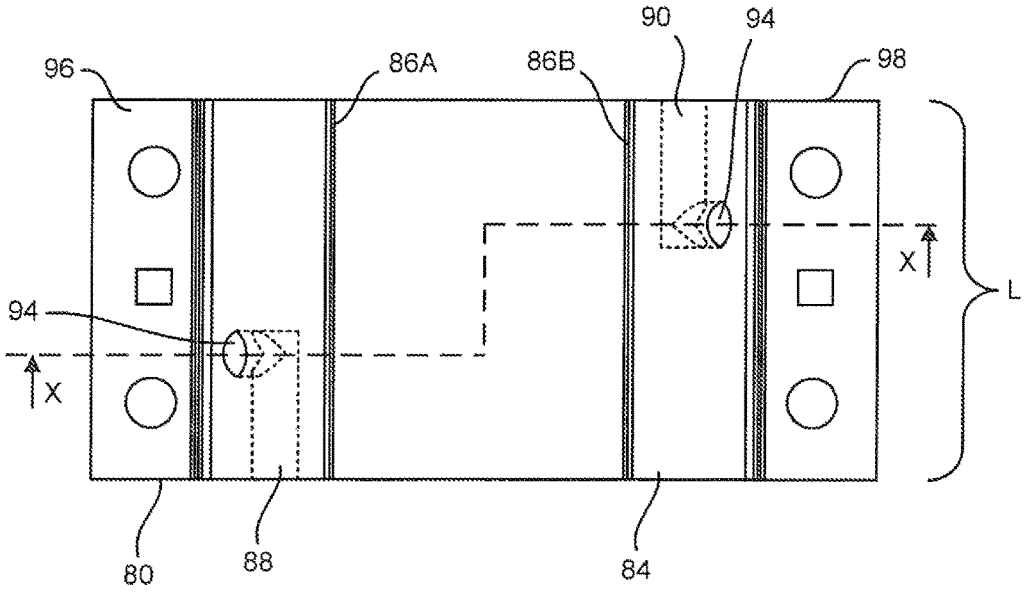
FIG. 3B shows a plan view of the tie plate of FIG. 3A.

Each protrusion is formed with a horizontal bore 88, 90 sized and shaped to receive an end 100 of a retainer clip, as discussed in more details below. Preferably, the length of each bore 88, 90 only needs to be same or a little longer then the length of clip end 100. Preferably, the depth of each bore 88, 90 is equal to or less than half the overall dimension L (FIG. 3B).

Preferably, a small hole 94 is provided at the end of each bore 88, 90. One purpose of the hole 94 is to allow personnel in the field during installation to clean out any foreign matter and debris from the respective bore 88, 90 thereby insuring that the clip ends 100 can be inserted into the bores easily. The hole 94 may also be used to secure the plate 80 to ensure that the plate is not stolen. The plate 80 further includes two lateral wings 96, 98 extending laterally outwardly from the bores 82, 84. These wings 96, 98 are formed with conventional apertures 99 for securing the tie plate 80 to conventional ties as described below.

The tie plate 80 is advantageous over the prior art plate of FIGS. 2A, 2B because its bores 88, 90 have much thicker sidewalls than the top walls of the cavities 60, 62. As a result the plate is stronger and is able to withstand large forces without being damaged. Another advantage of the plate 80 is that because the bores 88, 90, are closed, no foreign matter or debris can get into these bores after installation.

Figure 4:
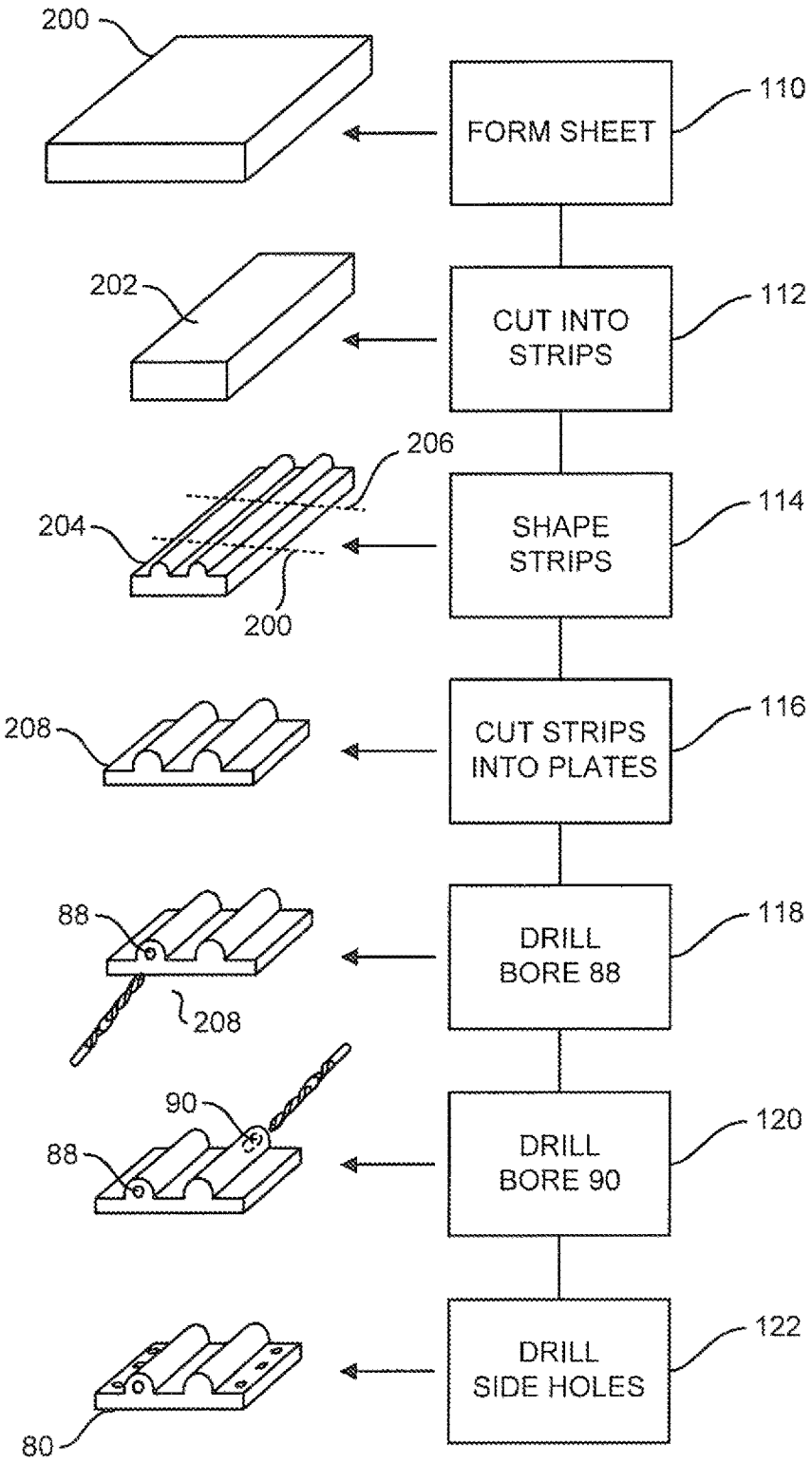
FIG. 4 shows a flow chart for manufacturing the tie plate of FIGS. 3A-3D.

The process for making a plurality of plates 80 is now described in conjunction with the flow chart of FIG. 4. In step 110 a flat sheet 200 of an appropriate metal alloy is formed using standard manufacturing techniques. In step 112 the sheet 200 is cut into several metal strips 202, each strip 202 having a width approximately equal to the desired length L of plate 80. (Dimension L is measured in a direction parallel to the rail 12).

Figure 3C:
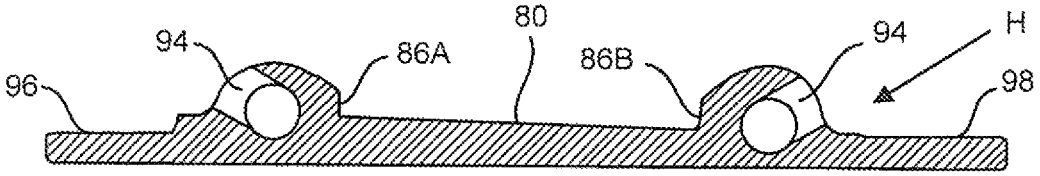
FIG. 3C shows a cross-sectional view of the plate of FIGS. 3A-3B taken along lines X-X.
Figure 3D:
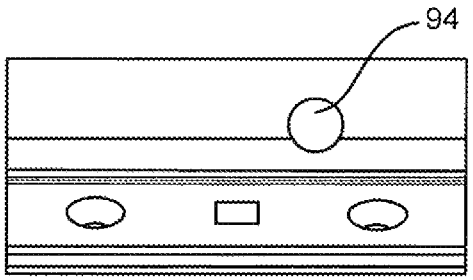
FIG. 3D shows an elevational side view of the tie plate of FIG. 3A-3C taken along direction H in FIG. 3C.
Figure 3E:
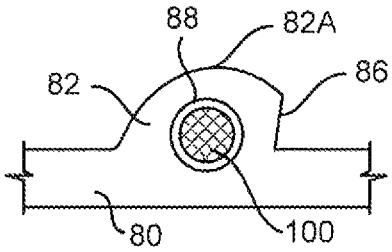
FIG. 3E is a somewhat enlarged end view of the plate of FIGS. 3A-3D showing an end of a clip being housed in a bore of the plate.

In step 114 each strip 202 undergoes a shaping process (for example, rolling) to form a shaped strip 204 having a predetermined cross sectional profile, such as the one shown in FIG. 3C.

In step 116, the shaped strip 204 is partitioned transversally along, lines 206 into several individual plates 208 using shearing or other conventional techniques. As can be seen in FIG. 4, the plates 208 do not have any bores or holes yet.

In step 118 bore 88 is made from one end of each plate.

In step 120 a second bore 90 is drilled from the other end of the plate.

In step 122 the apertures 99 are formed in the plate 208. Of course steps 118, 120, 122 can be interchanged, or performed simultaneously.

The end result is a plurality of plates 80 illustrated in FIGS. 3A-3D Because a significant portion of each protrusion 88, 90 does not include a bore, and because the bore has a diameter just large enough to receive the clip ends, the protrusions and the plate are much stronger and can withstand large distorting forces much better.

In an alternate embodiment, the protrusions 88, 90 extend only partially across the plate. Of course, in this case, each protrusion starts from a respective edge of the plate.

Figure 5A:
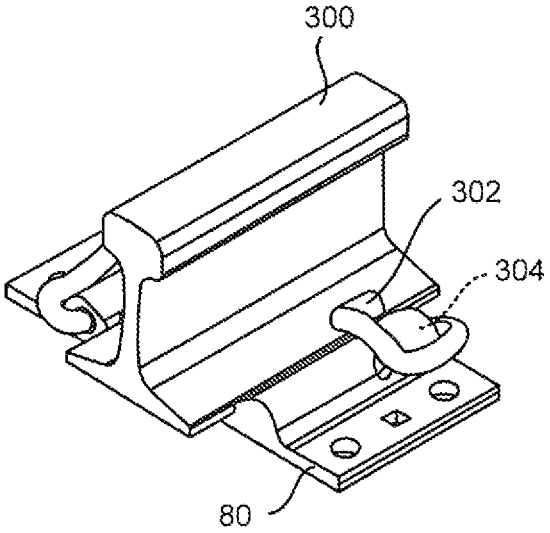
FIG. 5A shows an orthogonal view of the plate of FIGS. 3A-3D supporting a rail.
Figure 5B:
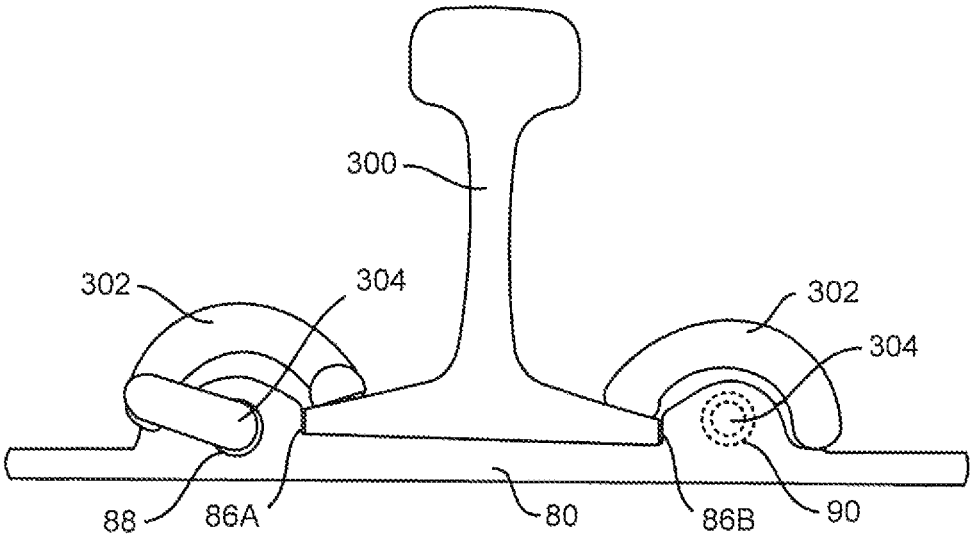
FIG. 5B shows a front view of the tie plate of FIG. 5A and the rail mounted thereon.

FIG. 5A-5B show the plate 80 supporting a rail 300. As can be seen in these figures, the rail 300 fits preferably snugly between walls 86A, 86B of plate 80. Standard spikes (not shown) can be used to attach plate 80 to a conventional tie. Clips 302 are used to attach and secure the rail 300 to the plate. Each clip 302 has a respective end 304 that is straight and extends into one of the bores 88, 90. As discussed above, prior to the present invention, separate shoulders had to be provided that were attached to a plate and were used to engage the ends 304 of clips 302. As a result of the present invention, separate shoulders are no longer necessary.

Numerous modifications may be made to this invention without departing from its scope as defined in the appended claims.

I claim:

1. A tie plate for securing a rail on a tie using first and second clips having respective clip ends, said plate comprising:

a relatively flat body having a first end, a second end and a top surface; and a first and a second protrusion formed integrally with said body and extending in parallel on said top surface, said first protrusion extending from said first end and second protrusion extending from said second end, said first and second protrusions being parallel to each other, said first protrusion being formed with a first bore sized and shaped to receive one of said clip ends, and said second protrusion being formed with a second bore sized and shaped to receive the other of said clip ends;

said protrusions and the clips cooperating to restrain the rail on said top surface;

wherein said protrusions have outer surfaces; and wherein each of said bores extends to a bore end within a respective one of said protrusions and wherein at least one of said bores is formed with a transversal cleaning hole having a cylindrical shape and extending from the respective bore end to the respective protrusion surface.

2. The tie plate of claim 1 wherein said first protrusion extends between said first and second ends.

3. The tie plate of claim 1 wherein said first protrusion extends only partially between said first and second ends.

4. The tie plate of claim 1 wherein said first and second ends are disposed at a distance L and said first and second bores have a length no more than L/2.

5. The tie plate of claim 1 wherein each clip end has a clip end length and said first and second bores have bore lengths at least equal to said clip end lengths.

* * * * *